United States Patent [19]

Cardenes Armas

[11] 4,014,782

[45] Mar. 29, 1977

[54] RESIDUAL FUEL DERIVING FROM PETROLEUM CRUDE BY THERMAL SHOCK CRACKING

[76] Inventor: Gregorio Cardenes Armas, Calle Paraguay 7, Las Palmas de Gran Canaria, Spain

[22] Filed: Jan. 23, 1975

[21] Appl. No.: 543,769

[30] Foreign Application Priority Data

Apr. 20, 1974 Spain ..... 425544

[52] U.S. Cl. ..... 208/130; 23/284; 196/98; 208/348; 208/363

[51] Int. Cl.[2] ..... C01G 9/34

[58] Field of Search ..... 208/125, 130, 348, 363

[56] References Cited

UNITED STATES PATENTS

| | | | |
|---|---|---|---|
| 1,358,174 | 11/1920 | Puening | 208/130 |
| 1,378,229 | 5/1921 | Hicks | 208/104 |
| 1,525,421 | 2/1925 | Wade | 208/130 |
| 1,613,010 | 1/1927 | Armstrong | 208/130 |
| 1,956,573 | 5/1934 | Haslam | 208/130 |
| 3,442,625 | 5/1969 | Knapp et al. | 208/125 |

*Primary Examiner*—Herbert Levine
*Attorney, Agent, or Firm*—Wenderoth, Lind & Ponack

[57] ABSTRACT

A process for improving a residual fuel derived from the distillation of petroleum crude includes originating a thermal shock by injecting water into residual fuel oil which has previously been heated to a temperature close to its boiling point, at a pressure equal to or slightly greater than atmospheric pressure, gas expansion being limited to the duration of the presence of water; and passing the gas formed as a result of the thermal shock to a gas expansion chamber, continuosly cooling the gas in a heat exchanger; and withdrawing the thereby liquified gas free from impurities.

6 Claims, 4 Drawing Figures

RESIDUAL FUEL DERIVING FROM PETROLEUM CRUDE BY THERMAL SHOCK CRACKING

BACKGROUND OF THE INVENTION

This invention relates to a process and a plant for improving any type of residual fuel derived from petroleum crude.

Residual fuels presently used suffer from the disadvantages of high viscosity, a sulphur content over 1.5% by weight, and have a maximum calorific value of 10,000 to 10,200 kilocalories per kilogram.

Residual oils of petroleum crude in general have the following characteristics.

| | |
|---|---|
| Density at 15° C | 0.900 (min.) |
| Flash point | 70° C (min.) |
| Viscosity in ° E at 20° C | 180 (max.) |
| Viscosity in ° E at 50° C | 20 (max.) |
| Sulphur % | 3 (max.) |
| Ash % | 0.2 (max.) |
| Water and sediments % | 1.0 (max.) |
| Maximum calorific value kcal/kg | 10,000 |
| Coke | 8 (max.) |
| The fuels have the following approximate percentage composition: | |
| Carbon | 84–87% |
| Hydrogen | 12–14% |
| Sulphur | 0.5–4: (according to origin) |
| Vanadium | 70 ppm. |
| Nickel | 30.5 ppm. |

Considering the low quality of residual fuels derived from the distillation of petroleum crude of any origin, and the consequences which this has where the control of pollution is considered, and further considering the interest which exists in economising fuel of every type, it is clearly desirable to obtain combustible oils with the lowest possible sulphur content, the lowest possible viscosity at a given temperature, and the highest possible calorific value, that is to obtain a greater number of therms per kilogram of fuel than at present.

It must be stated that up to the present time, although applications for the distillation residue of petroleum crude have been sought and found, there has been no attempt to improve these residues.

SUMMARY OF THE INVENTION

The present invention in one aspect provides a process for improving a residual fuel derived from petroleum crude including originating a thermal shock by injecting water only and in the liquid state into fuel oil in the liquid state, which has previously been heated to a temperature close to its boiling point, at a pressure equal or slightly greater than atmospheric pressure, gas expansion being limited to the duration of the presence of water; and passing the gas formed as a result of the thermal shock of the fuel oil and water only to a gas expansion chamber; continuously cooling the gas in a heat exchanger; and withdrawing the thereby liquified gas free from impurities.

A plant for carrying out the process according to the invention may include a thermal shock chamber, means for passing fuel oil and water into the thermal shock chamber, a gas expansion chamber communicating with the thermal shock chamber, a heat exchanger downstream of the gasification chamber, and means for withdrawing liquified gas which has been cooled by the heat exchanger.

The process according to the invention enables the sulphur content and viscosity to be lowered and enables the 10,000 kilocalories/kilogram demanded from any residual fuel to be maintained or increased, and furthermore a greater quantity of fuel oil may be obtained than hitherto.

Thus, starting from a residual liquid of any origin derived from distillation, there may be obtained a combustible oil or fuel oil, including gas oil, which has better characteristics as a fuel than the initial residual petroleum crude fraction, and which also has a lower content of sulphur and non-combustible matter. This is a great advantage where control of environmental pollution is desired. In addition to this qualitative improvement, an important quantitative improvement is obtained in that a fuel of greater quantity than that initially used may be obtained.

In summary, the fuel obtained by the process according to the invention has improved characteristics, exceeding those of a residual fuel, thus facilitating control of environmental pollution and the economising of fuel.

The process according to the invention is based on regulating pressures and temperatures in the presence of water and the residual oil derived from petroleum crude to obtain saturation of acetylenic and olefinic bonds by intermolecular action and by fissioned fractions of water molecules, and to polarise the water molecules, both with respect to the free molecules obtained, and in the known zones of electrical density, and also in the vicinity of the residual Thiel valencies.

The process according to the invention starts with residual oils having for example an analysis as follows:

| | |
|---|---|
| Sample No. 1 (Initial residual oil) | |
| Flashpoint (v.c.) | 78° C |
| Viscosity at 20° C | 730° E |
| Viscosity at 50° C | 57° E |
| Water (dst.) % vol | 0 |
| Sulphur | 2.48% |
| Calorific value cal/gr (maximum) | 10,200 |

| | |
|---|---|
| Sample No. 2 (Initial residual oil) | |
| Sulphur | 2.48% |
| Water by extraction | 0.8 |
| Viscosity at 50° C | 40° E |
| Viscosity at 70° C | 12° E |
| Maximum calorific value cal/kg | 10,136 |
| Flashpoint greater than | 110° C |
| Nickel | 30.5 ppm. |
| Vanadium | 70 ppm. |
| V/Ni | 2.3 ppm. |

The combustible oil obtained by the process according to the invention may have for example the following composition.

| | |
|---|---|
| Sample No. 3 (Gas oil obtained by the process) | |
| Flashpoint (v.c.) | 108° C |
| Viscosity at 20° C | 1.83° E |
| Viscosity at 50° C | 1.33° E |
| Water (dst) % vol. | 1.2 |
| Sulphur, gr/100 | 1.25 |
| Calorific value cal/gr. | 10,570 |

| | |
|---|---|
| Sample No. 4 (Gas oil obtained by the process) | |
| Sulphur | 0.16 |
| Water by extraction | 5.8 |
| Water by Karl Fisher determination | 5.02 |
| Viscosity at 50° C | 1.52 |
| Viscosity at 20° C | 2.64 |
| Calorific value cal/kg. | 10,024 |
| Lower calorific value cal/kg. | 9,606 |
| Flashpoint greater than | 110° C |
| After 48 hours drying with CHCA | 110° C |
| Nickel | 4.1 ppm |
| Vanadium | 7 ppm |
| V/Ni. | 1.7 ppm. |

It is evident that the fuel obtained by the process of the invention is of much improved quality over that of the initial fuel, with the attainment of a greater number of therms per litre of residual fuel and with very favourable characteristics from the point of view of atmospheric pollution.

It is important to emphasise that the figures given for the new gas oils and fuel oils obtained correspond to certain tests under determined operating conditions, which can be varied over a wide range and so allow different fuel oil specifications to be obtained for example, with respect to viscosity, free water, and sulphur, vanadium and nickel content. Moreover, new fuel oils can be obtained having a viscosity of 2,000° E at 20° C.

Consequently the raw materials used in the process according to the invention are readily obtainable and of very low price, do not give rise to any problems and, on the contrary, represent great advantages, in that hitherto 50% of petroleum crude has been considered as residue because of its very low quality.

In a preferred manner of carrying out the process according to the invention, the residual oil is first exposed to an average temperature of 300° C (which may be higher or lower) and is acted upon by water, which may also be residual, producing by thermal shock a violent partial gasification into the vapour phase with entrainment by reflux, and while the heavier fractions are recycled by convection, the selected portion is passed to an outlet pipe, to reach a heat exchanger where the gas oil, which has an improved specification, is obtained by condensation. The small quantity of free water which accompanies the product obtained is separated by gravity inside the body of the receiver.

To summarise, the basis of the process according to the invention is to cause a thermal shock between the water and residual oil to variable degrees in accordance with the operating temperature and pressure.

BRIEF DESCRIPTION OF THE DRAWINGS

The invention will be further described, by way of example only, with reference to the accompanying drawings, in which.

DETAILED DESCRIPTION OF THE INVENTION

Figure 1:
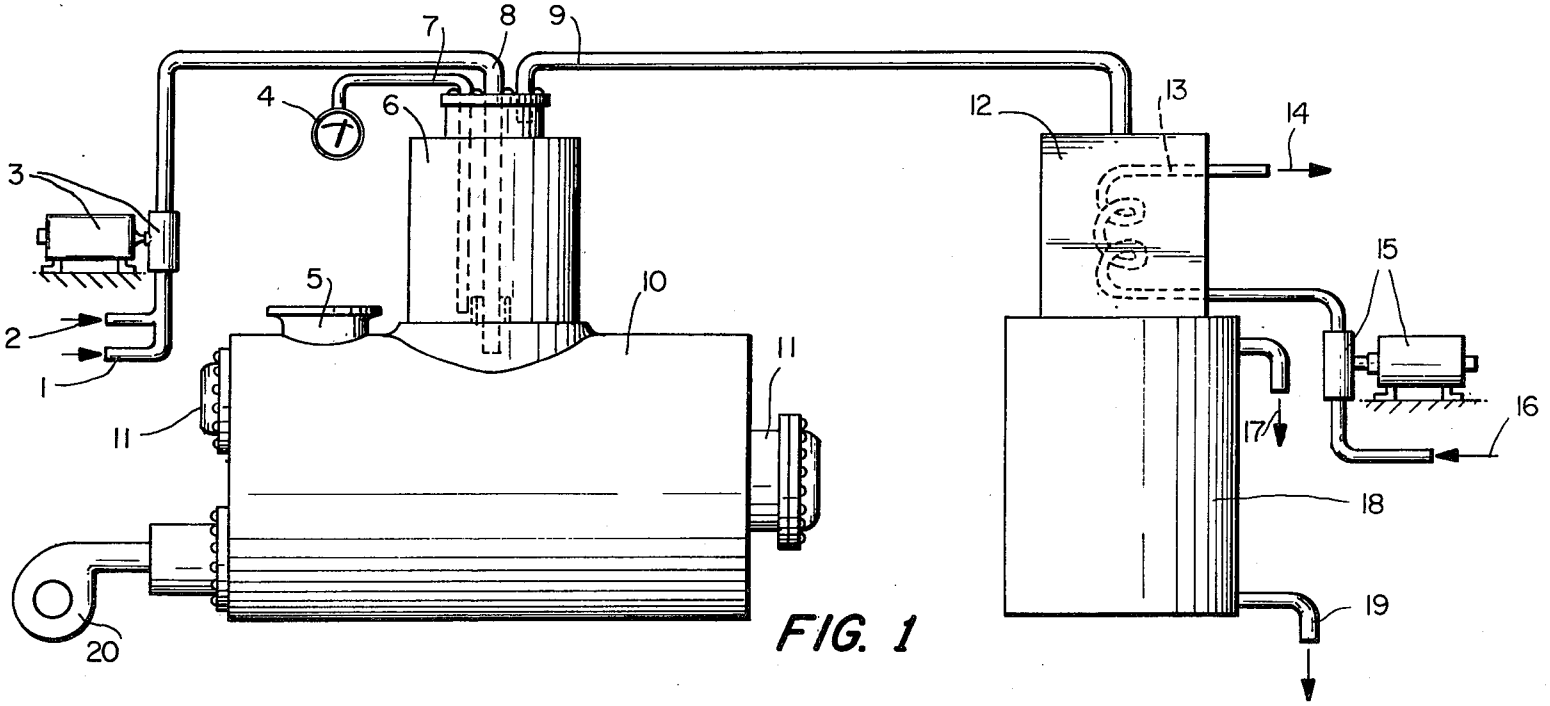
FIGS. 1 and 2 are diagrammatic elevational and plan views respectively of a plant for carrying out the process according to the invention.
Figure 2:
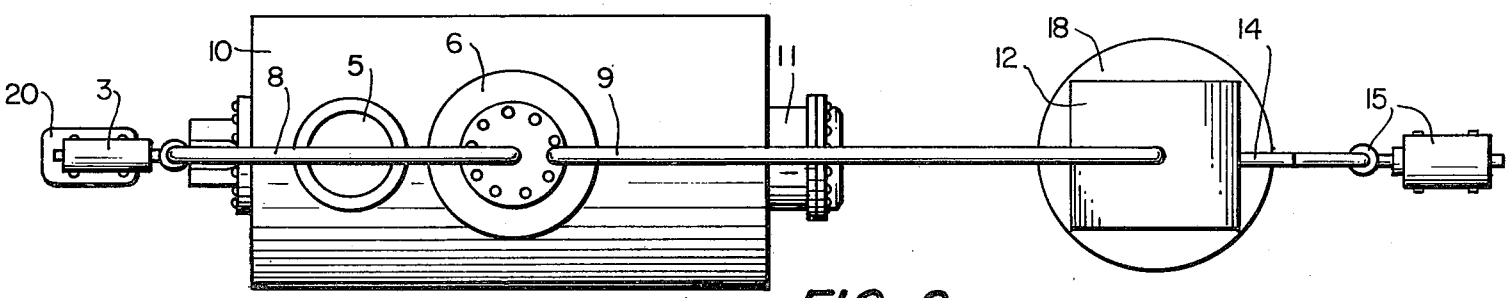

The plant shown in FIGS. 1 and 2 comprises a thermal shock chamber 10, at the top of which is located a gas expansion and dephlegmation chamber 6, at the top of which are disposed inlet pipes 8 for water and fuel oil, a temperature probe located at the bottom of a tube 7 in the chamber 6, and an outlet pipe 9 for gases which pass to a condenser 12 and a receiver 18 having therein a decantation chamber.

The temperature probe 7 controls a pump 3 which delivers a suitable quantity of residual oil and water from inlets 1 and 2, and likewise controls the automatic start-up and stoppage of a burner 20. The condenser 12 contains a heat exchanger 13 fed by a pump 15, and incorporates pipes 16 and 14 for the inlet and outlet respectively of cold water. The receiver 18 incorporates an outlet 17 for the gas oil obtained and another outlet 19 for the water and residues.

Figure 4:
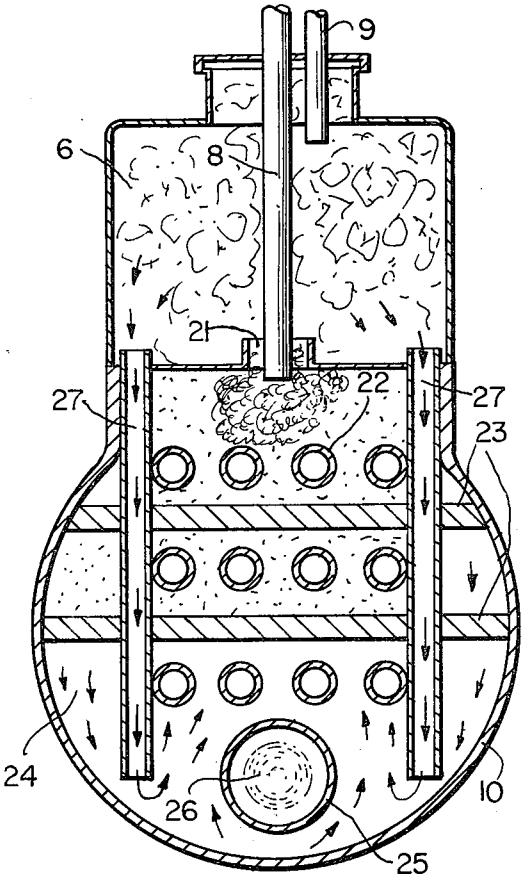
FIG. 4 is a cross-section through the thermal shock chamber shown in FIG. 3.
Figure 3:
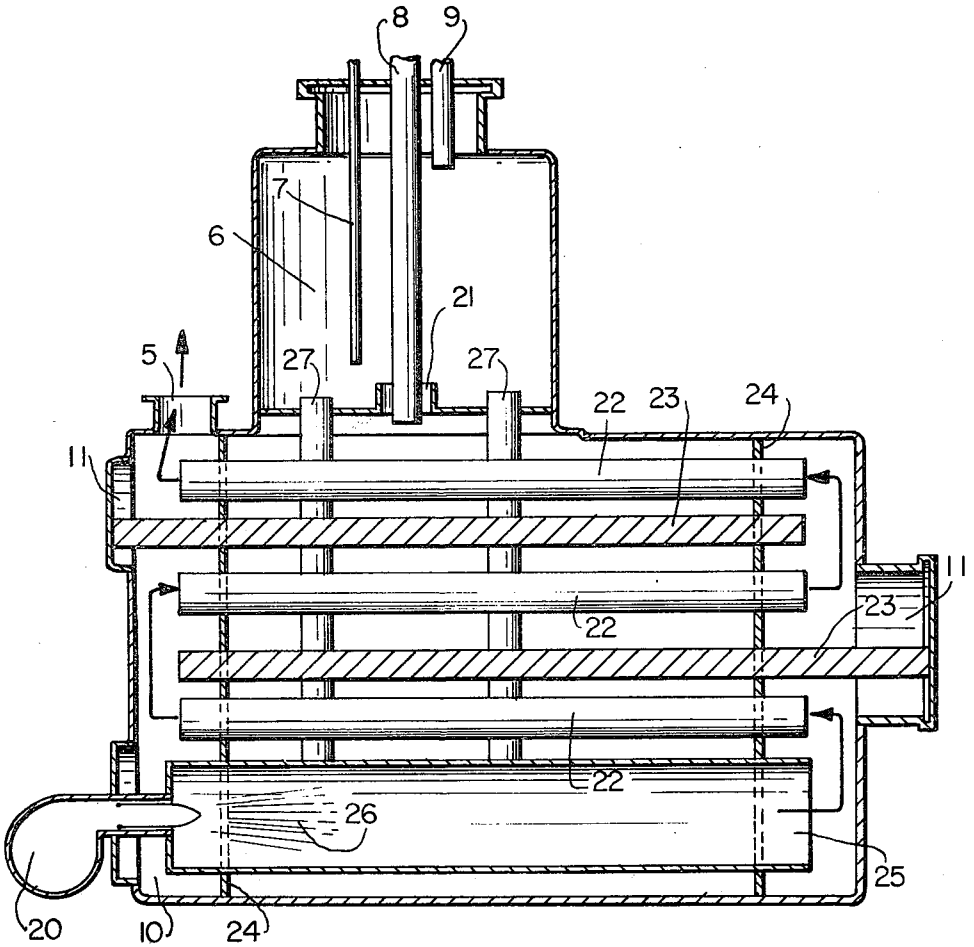
FIG. 3 is a longitudinal partly sectional view through the thermal shock chamber of the plant shown in FIGS. 1 and 2.

FIGS. 3 and 4 show the thermal shock chamber 10 and the gas expansion and dephlegmation chamber 6. In the chambers 10 and 6 a flame 26 of the burner 20 penetrates a combustion chamber 25 and the hot gases proceeding from the chamber 25 pass through pipes 22, with sufficient time for heat exchange with the residual oil surrounding the pipes and separated from the interior of the combustion chamber by walls 23 and 24, the transfer of heat cooling the gases which are then evacuated to the outside through an exit nozzle 5.

When the residual petroleum crude oil has been so conditioned, it receives water through a pipe 8, giving rise to thermal shock in the pipe 8 and at the top of the pipes 22. Once the thermal shock has originated, the residual oil expands violently and passes to the chamber 6 through a diffuser 21 formed by an annular space between the water feed pipe 8 and the outlet concentric with the pipe.

Vapourisation takes place in the top of the chamber 6, the heat being propagated by the convection currents which are formed by the ascent of the hotter parts because of expansion, and the descent of the colder parts. The gases rise through the pipe 9, and the heavier fraction (of greater specific gravity because of its lesser expansion) passes through pipes 27 to be recycled through the process.

In FIG. 4 the liquid convection movement is shown diagrammatically by pointed arrows and the gaseous convection movement by dots.

The chamber 10 also includes control and cleaning access holes 11 and supports 24 for the pipes 22 and combustion chamber 25 which give total rigidity to the assembled system.

The temperature probe located at the bottom of the tube 7 and connected to a temperature recorder 4 also permits positioning of the internal residual oil level, and in the recorder 4 there are various electrical contacts which operate relays to automatically start the injector pump to raise the oil level. When the temperature is adequate, i.e., reaches a desired level, the system ceases to inject oil and begins to inject water.

The advantages of the process and plant described above are as follows:

Fuel economy, or in other words lower cost per therm obtained, and in addition lower consumption of residual petroleum crude derivatives for the same calorific value.

Avoidance of environmental pollution by oxides of sulphur, smoke and non-combustible matter, and compounds of vanadium, nickel and those contained in the ash deriving from residual fuels of petroleum crude.

Overcoming of the problems of "lower" corrosion by oxides of sulphur by raising the acid dewpoint temperature, and avoiding of problems of "upper" corrosion by vanadium and sodium compounds.

The obtaining of gas oil which is better than the initial oil from the point of view of economy and environmental pollution, these results being obtained by processes based on kinetic chemistry which occur in all sections of the plant.

Special thermal shock oil conditions are established in each case between a residual oil derived from petroleum crude and water.

A fuel is obtained of improved application with respect to that of any residual oil, since the fuel obtained does not give rise to problems of corrosion and pollution, and is economical by resulting not only in improved quality, but also improved quantity and at a lower cost.

The burner 20 shown in FIGS. 3 and 4 represents a source of heat. Considering that the operating temperature is on an average 300° C, any heat source may be employed which is sufficient for this purpose, such as the latent heat of water vapour, radiation from internal combustion engine exhaust pipes, or heat derived from combustion of gases or liquid fuels.

I claim:

1. A process for improving a residual fuel derived from the distillation of petroleum crude, said process comprising:

heating a residual fuel derived from the distillation of petroleum crude to a temperature near its boiling point while maintaining said residual fuel in the liquid state;

injecting water only, in the liquid state and at a pressure equal to or slightly greater than atmospheric pressure, into the heated liquid residual fuel, thereby causing a thermal shock and violent gasification and expansion of said residual fuel and water only;

passing directly into a gas expansion chamber the gas formed by said thermal shock of said residual fuel and water only without having added thereto any other components or without having added thereto any other components or without undergoing any additional heating treatment;

immediately thereafter continuously cooling said gas in a heat exchanger to form liquified gas without having added thereto any other components or without undergoing any additional heating treatment; and withdrawing said liquified gas as improved fuel free of impurities.

2. A process as claimed in claim 1, wherein said step of heating comprises surrounding a second heat exchanger, provided in a thermal shock chamber, with said residual fuel, and conveying a heat exchange fluid through said second heat exchanger, thereby heating said residual fuel.

3. A process as claimed in claim 2, wherein said water in the liquid state is injected into said thermal shock chamber, and said thermal shock occurs in said thermal shock chamber.

4. A process as claimed in claim 3, wherein said step of passing comprises conveying said gas formed by said thermal shock in said thermal shock chamber through a diffuser into said gas expansion chamber.

5. A process as claimed in claim 4, wherein a liquid convection movement is formed in said residual fuel within said thermal shock chamber during heating of said residual fuel; and a gaseous convection movement is formed in said gas expansion chamber due to ascent of lighter fractions of said gas subjected to greater expansion and to descent of heavier fractions of said gas subjected to lesser expansion, said heavier fractions returning to said thermal shock chamber.

6. A process as claimed in claim 1, wherein said step of withdrawing comprises passing said liquified gas directly from said heat exchanger to a decantation chamber, and separating and collecting said liquified gas free from any water or residue.

* * * * *